US005881384A

United States Patent [19]

Williams

[11] Patent Number: 5,881,384

[45] **Date of Patent: *Mar. 16, 1999**

[54] COMMUNICATION AND DISPLAY DEVICE FOR THE HAND

[76] Inventor: Douglas Anthony Williams, 926 Victoria Landing Dr., Woodstock, Ga. 30188

[ * ] Notice: This patent issued on a continued prosecution application filed under 37 CFR 1.53(d), and is subject to the twenty year patent term provisions of 35 U.S.C. 154(a)(2).

[21] Appl. No.: 797,423

[22] Filed: Feb. 10, 1997

Related U.S. Application Data

[63] Continuation of Ser. No. 406,026, Mar. 17, 1995, abandoned.

[51] Int. Cl.[6] ..... A41D 19/00

[52] U.S. Cl. ..... 2/158; 2/159

[58] Field of Search ..... 2/158, 159; D2/617, D2/619, 622, 623, 610; 434/112; 40/586

[56] References Cited

U.S. PATENT DOCUMENTS

| | | | |
|---|---|---|---|
| 1,244,065 | 10/1917 | Miller | 2/159 X |
| 1,624,429 | 4/1927 | Palmer | 2/159 X |
| 1,630,730 | 5/1927 | Daugherty | 2/159 X |
| 3,403,408 | 10/1968 | Helfer | 2/158 |
| 4,486,975 | 12/1984 | Herreld et al. | 40/586 X |
| 4,670,930 | 6/1987 | Lu | 2/158 X |
| 5,050,596 | 9/1991 | Walasek et al. | 2/158 X |
| 5,369,257 | 11/1994 | Gibbon | 2/158 X |

FOREIGN PATENT DOCUMENTS

| | | | |
|---|---|---|---|
| 1581453 | 12/1980 | United Kingdom | 434/112 |
| 2277864 | 11/1994 | United Kingdom | 2/159 |

OTHER PUBLICATIONS

Earnshow's Infant's Review, Jun. 1977, vol. 61, p. 1–7.

*Primary Examiner*—Michael A. Neas
*Assistant Examiner*—Shirra L. Jenkins
*Attorney, Agent, or Firm*—Michael F. Labbee; John S. Pratt; Kilpatrick Stockton LLP

[57] ABSTRACT

A directable, hand-wearable communication device provides a frontal display surface and a rear display surface to which images can be applied for promoting teams, athletes, corporate sponsors, political parties and the like. Frontal and rear display surfaces may be provided by corresponding members that are joined at their perimeters to form a pocket for receiving a human hand and presenting no obstructions between the fingers, including the thumb. The device has an aperture at the lower extremity of the joined perimeter for permitting access by the hand to the pocket. An elastic neck portion is preferably joined along the edge of the aperture to snugly fit around the wrist of the wearer and keep the device securely in his or her possession, particularly during vigorous use. The display surfaces provided by one or both of the front and rear sides of the device are provided with an image, such as a graphic image, an alphanumeric symbol, a team or corporate logo, or any other image a wearer may wish to display and thereby communicate.

8 Claims, 1 Drawing Sheet

COMMUNICATION AND DISPLAY DEVICE FOR THE HAND

This application is a file-wrapper continuation, of application Ser. No. 08/797,423, filed Feb. 10, 1997, which is a continuation of application Ser. No. 08/406,026, filed Mar. 17. 1995.

This application is a file-wrapper continuation, of application Ser. No. 08/406,026, filed Mar. 17, 1995, now abandoned.

FIELD OF THE INVENTION

The present invention relates in general to communication devices and, in particular, to communication devices that may be worn by a user.

BACKGROUND OF THE INVENTION

Large scale public gatherings, such as sporting events, automobile races, political conventions and rallies, ticker tape parades, and other mass meetings provide opportunities for large numbers of people having an emotional or intellectual attachment to an ideal, organization, team, celebrity athlete, or other focus of attention to meet en masse in a public forum. Most attendees of these gatherings are supporters, boosters or fans of a participant or group of participants in the public event and have a high level of enthusiasm. Sporting events and political conventions are two of the best known sorts of gatherings in which members of large crowds permit themselves to display their enthusiasm not merely in public, but often in the presence of television cameras. At these events, banners are waved, cheers erupt, and shouts of encouragement occur. A crowd will sometimes take collective action, performing what has become known as "the wave" around a stadium holding tens of thousands of people. The highly public nature of the setting seems to fuel the fervor of the crowd, and the willingness of crowd members to display their emotion.

This expression of emotion, in addition to being enjoyable, serves important public functions, including the constructive, or at least passive channeling of public energy and the rallying of a community about a common cause. High-spirited public events stimulate the economy, bring a wholesome sense of well being to a community, and become the vehicle for regional or institutional spirit and unity.

In addition, the settings in which gatherings occur provide an opportunity for the promotion of products, services, events and attractions of interest to the attendees. Attendees are generally predisposed during these events to consume freely, taking advantage of the comparatively rare opportunity to indulge themselves in something they enjoy.

Sporting events in particular present promoters of products, services, events and other commercial activities an opportunity to reach a receptive audience, and one whose members are likely to be demographically well-understood. The tastes and preferences of these individuals may therefore be effectively targeted, so that an efficient match can be made between them and purchasing opportunities they are likely to find of interest. Promoters of products and services frequently consider it advantageous to establish a linkage between a popular competitor, such as a race car driver, golfer or other figure and a product or service. Not only does the attention paid to the public figure provide camera exposure for trademarks and logos associated with the product or service being promoted, but an element of celebrity or team sponsorship or endorsement is introduced, so that fans or spectators who admire and trust a particular athlete or other public figure will consider favorably the good or service being endorsed.

In recent years, opportunities for promotion of goods and services at public gatherings have been limited by physical constraints on available space. Scoreboards, billboards, automobile bodies, golf bags and similar objects present a decidedly finite number of opportunities, and this scarcity has driven up their price. In some instances, the fans or spectators themselves can present an opportunity for promotion, through the sale of hats, tee shirts and similar products. Some venues, however, prohibit certain of the more obtrusive means for expressing spirit, such as banners and other larger objects.

Between the need to expand beyond the presently saturated market for opportunities for promotion, and the inherently large and animated promotional vehicle presented by spectators themselves, an unmet need apparently exists for a device capable of harnessing that vehicle by providing a new means for fans and supporters to communicate their spirit and enthusiasm, while at the same time providing a new set of opportunities for promotion of teams, athletes or other public figures, as well as goods and services of interest to spectators.

SUMMARY OF THE INVENTION

The present invention provides a device capable of addressing the unmet need described in the previous section. In particular, the present invention provides a communication and promotional display device that is wearable and directable. The device according to the present invention is unlike garments bearing images or alphanumeric symbols, such as college sweatshirts, ballcaps with team insignia, and the like. With such garments, any display is merely incidental to the basic function of covering the body. The device of the present invention, by contrast, is directed to and oriented around the act of directed display and communication of team spirit, devotion to a sports organization or individual athlete, or affiliation with a common cause, and achieves this purpose and function in a way that garments cannot.

The human hand provides a unique and previously insufficiently recognized platform for visual communication of graphical and/or symbolic messages. The hand is directional. It may be raised above the body. It can be waved around. Hands can be "hi-fived." They may be moved much more rapidly than can the body, shooting skyward upon the scoring of a touchdown, for example. In short, hands enable a human to attract attention and express emotion in a unique and powerful way.

The present invention increases the expressive power of the human hand in the context of the drama of athletic competitions or other events by providing an inexpensive, conveniently stored, instantly donned, and highly visible, positionable and directable platform for the communication of messages of an athletic, political, or commercial nature. The device according to the present invention provides a platform for expression and communication that can be simultaneously bi-directional. Moreover, the device provides this communication platform in a manner that is simple to produce, lightweight, easily stored in a pocket when not in use, and which, when in use, can permit activities like holding a drink or mopping a brow.

To achieve these ends, the device according to the present invention provides a hand-wearable, directable device for permitting a wearer to communicate visually to one or more viewers, having a body portion with a first side and a second side surrounding an interior pocket for receiving a hand, and also having an aperture through one end and through which the hand passes when being received in the interior pocket. The body portion interior pocket is adapted to receive the hand without presenting obstructions between the fingers, including the thumb. In addition, the device includes at least one image coupled to at least one side of the body portion. Using the device having this structure, the wearer can communicate with the one or more viewers by directing the hand that has been received in the device, and thereby the device itself, in the field of view of the one or more viewers so that the image is visible in that field of view.

The device can also include a neck portion having an aperture and coupled to the body portion adjacent the aperture in the body portion, such that the wearer's hand passes through neck portion aperture prior to passing through the body portion aperture when the device is placed on the hand. When included as part of the device, the neck portion thus fits around the wrist of the wearer and assists in maintaining the body portion on the hand of the wearer.

Accordingly, it is an object of the present invention to provide a directable device, for communication and promotion using images, that may be worn on the hand.

It is a further object of the present invention to provide a directable, hand-wearable communication device that permits a wearer to communicate a visual message at a public gathering without excessively obstructing the fields of view of others.

It is another object of the present invention to provide a directable, hand-wearable communication device that may be easily manufactured from conveniently available materials.

It is yet another object of the present invention to provide a directable, hand-wearable communication device that may conveniently stored and transported by a wearer in his or her pocket, for instance.

DETAILED DESCRIPTION

Figure 1:
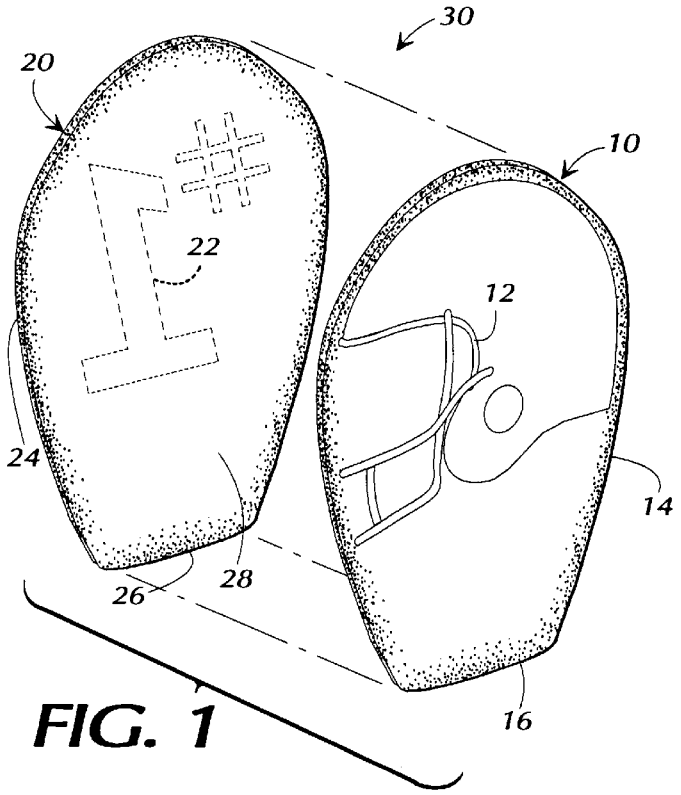
FIG. 1 shows an exploded view of portions of the body of a device according to the present invention

FIG. 1 shows in an exploded view portions of the body portion 30 of one embodiment of the directable display and communication device according to the present invention. A frontal portion 10 on one side of the body portion 30 is, without limitation, generally of flexible sheeting material. Frontal portion 10, as shown in the embodiment of the device depicted in FIG. 1, but without limitation, has a generally oval peripheral contour 14, tapering to a narrowed and comparatively straight lower edge 16. The generally oval shape provides an aesthetically pleasing contour, but is only one of a variety of possible shapes for frontal portion 10 (and also for rear portion 20, as discussed below). Whatever the shape, however, it should most preferably be convex in geometry (i.e., having no appreciable peripheral indentations) and thus provide the maximum amount of uninterrupted surface area for displaying images, which will be described at further length below.

A rear portion 20 on a second side of body portion 30, also without limitation, has a generally oval peripheral contour 24, tapering to a narrowed and comparatively straight lower edge 26, the geometry of rear portion 20 being as close to identical to that of frontal portion 10 as reasonably possible (even if frontal portion is a shape other than the generally oval one shown in the Figures).

Frontal portion 10 has an image 12 affixed to its surface. In the illustrated embodiment, but without limitation, the image 12 is one of a football helmet. Rear portion 20, also in this view, has an image 22 disposed on its display surface and thus visible only in phantom. Unlike the image 12 on the display surface of frontal portion 10, image 22 in the illustrated embodiment, but without limitation, is not a graphic image, but rather is an alphanumeric image.

Frontal portion 10 and rear portion 20 are most preferably cut to a shape substantially, although without limitation, as shown in the figures. The dimensions of frontal portion 10 and rear portion 20, and thus of body portion 30, are preferably in excess of the peripheral dimensions of the fully opened hand of the intended wearer. This sizing provides a front and rear display area larger than the wearer's hand, although not large enough to significantly obstruct the fields of view of the wearer's fellow spectators or crowd members. In the extreme, the maximum width of the device for an average adult male user should preferably be at least about 6 inches, and its maximum height preferably at least about 9 inches. For intended users of the device whose hand sizes are smaller, such as women, children or even infants, the dimensions preferably are proportional. Given the above-described dimensions for the front and rear display surfaces of the device provided by frontal portion 10 and rear portion 20, each of the surfaces provides a substantially convex and thus uninterrupted display area of preferably at least about 35 square inches for a device wearable by an average adult male, and proportionally smaller for women, children and infants.

Prior to being joined, frontal and rear portions 10 and 20 are aligned so that their peripheries are collocated and an enclosed space or pocket 28 is created. Pocket 28, as can be seen in FIG. 1, is most preferably a simple, undivided space having no partial walls or septa to separate any one or more of the fingers, including the thumb, from any other.

Frontal and rear portions 10 and 20, respectively, are joined in position using any suitable means, preferably by sewing. The peripheries of portions 10 and 20 are not sewn all the way around, however. Rather, the peripheries of portions 10 and 20 are left unjoined along their respective lower edges 16 and 26 to leave an aperture through which a hand may be inserted in order to occupy pocket 28.

Figure 2:
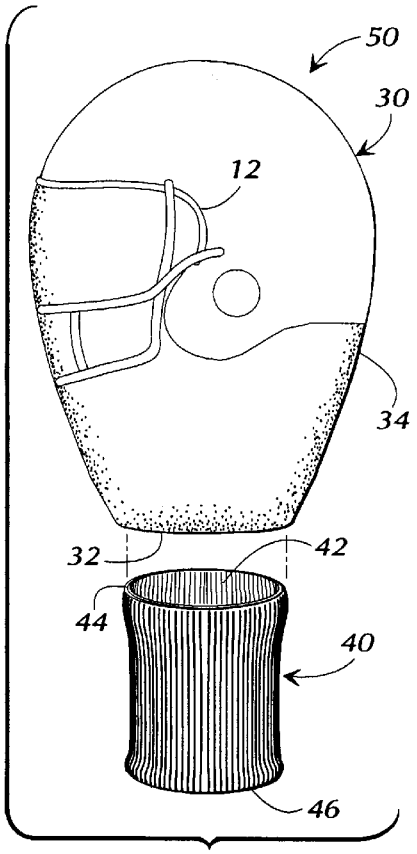
FIG. 2 shows a view of a device according to the present invention in which the body and the neck portion of the device are shown in exploded form.

As shown in FIG. 2, the result of the joining of frontal portion 10 with rear portion 20 is body portion 30, having a contoured periphery 34 defined by the contoured peripheries 14 and 24 of frontal and rear portions 10 and 20, respectively. Body portion 30 also has an aperture 32 respectively defined by edges 16 and 26 of portions 10 and 20. In an additional step, also shown in FIG. 2, a neck portion 40, having an aperture 42 defined at its upper extent by edge 44 and at its lower extent by edge 46, is joined to body portion 30 by any suitable means, preferably by sewing. Although neck portion 40 may be of any material or configuration suitable for achieving a snug fit about the wrist of the wearer and thus comfortably securing the device 50 to the hand of the wearer and holding it fast throughout vigorous use, neck portion 40 is preferably a ribbed and/or elasticized fabric or other material of the kind used for cuffs attached to the sleeves of long sleeved sweatshirts or similar garments. Neck portion 40 alternatively could be any structure capable of releasably maintaining a constriction about the wrist, including, without limitation, hook and loop fasteners.

Upper edge 44 of neck portion 40 is aligned with edges 16 and 26 of joined portions 10 and 20 and is fastened to it, preferably, although without limitation, by sewing. To be properly joined, the circumference of neck portion 40, when in a relaxed state, should be as close in size as possible to the circumference of aperture 32. Although the illustrated embodiment is conveniently formed from three major components as described in connection with the illustrated embodiment, other configurations are within the contemplation of the present invention. For example, alternative embodiments of device 50 could be fabricated with a greater or fewer number of components than the three major components of the illustrated embodiment, subject to the constraint that the device be hand-wearable, and have two major sides or display surfaces.

The described embodiment of the device according to the present invention is simple and accordingly easy and inexpensive to fabricate. The frontal and rear portions 10 and 20 can be a simple contour that, unlike a glove or mitten for permitting manual manipulation functions, need not be anthropomorphic. The portions, moveover, and the manner in which the portions are joined, need not be shaped or formed to accommodate the front-to-back asymmetry of the flexure of the human hand. Indeed, the two portions can be cut or otherwise formed so as to have identical and symmetrical geometry side-to-side and front-to-back.

The device may nevertheless have a preferred orientation. In particular, frontal portion 10 is intended to correspond to the palm of the wearer's hand, while rear portion 20 is intended to correspond to the back of the wearer's hand. Since the geometry of the device is preferably symmetric front-to-back as well as side-to-side, the preferred orientation may be expressed through different choices as to materials, colors and images to be used on each side. For instance, the front and back portions can be of different colors or even different fabrics or other materials. As another example, the frontal portion 10 can be of a breathable mesh fabric, while the rear portion 20, which may be exposed to the sun's rays for longer periods of time than the frontal portion 10, can be of higher opacity.

Frontal portion 10 and rear portion 20 of the illustrated embodiment of the device 50 according to the present invention may include more than one layer of material. For example, a lighter, more decorative material may be supported by a stiffer and heavier though less decorative material to enable the device 50 to better hold a particular shape.

The fabric from which frontal portion 10 and rear portion 20 of body 30 are made may, for example and without limitation, be of cotton or a cotton blend, wool, canvas, denim, flannel, nylon, poplin, polyester, polypropylene, rayon, terry cloth, suede, leather, seersucker, satin, silk, velvet, or any other natural or synthetic material suitable for receiving one or more images according to techniques further described below. The weight and the consistency of the material may range from a very sheer material, to a lightweight tee shirt material or a mesh of the type often used in football jerseys, to a heavier fabric of the sort used in sweatshirts. The device 50 could even be of a stiffer consistency, such as a fabric of the type used in the making of ball caps, or even be of suede or leather as listed above.

The material for a given embodiment of the device 50 can be selected to provide any desired properties. For example, embodiments of the devices 50 incorporating terry cloth would be most useful in warmer regions or climates, whereas woolen embodiments would perhaps be most suitable for use in colder regions or climates.

The material used to form frontal and rear portions 10 and 20, respectively, of the embodiment of the device 50 according to the present invention should be capable of receiving a graphic or alphanumeric image or design. As shown in FIG. 1, frontal portion 10 has a graphic design 12 applied to its outer surface, which may be considered a display surface. The image 12 may be applied according to any known method, including, without limitation, silk screening, iron-on or other elastomeric laminate, embroidery, sewn-on patch, fabric painting, Jacquard or other known methods.

Figure 3:
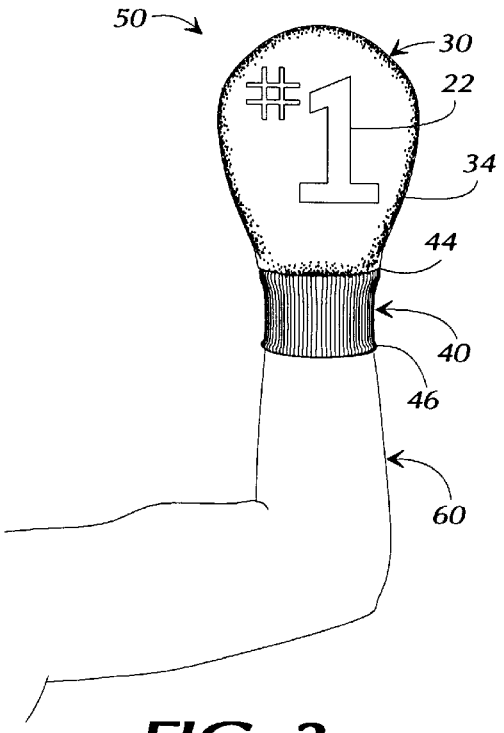
FIG. 3 shows a device according to the present invention in use, the rear portion and corresponding display surface of the device being visible in this view.

FIG. 3 shows an embodiment of the device 50 according to the present invention in use on the hand of a wearer 60, only the arm of which is visible in this view. The entire hand of wearer 60 is received in pocket 28 (not directly visible in this view) and neck portion 40 fits snugly around the wrist, securing device 50 and maintaining it in position during vigorous usage. In FIG. 3, the rear portion 20 of device 50 is visible. When wearer 60 raises a hand on which device 50 has been placed, wearer 60 can communicate the message present in image 22 with others in whose general field of view he or she is able to place his or her hand and device 50. For instance, if wearer 60 is in a stadium or arena attending a sporting event, raising even slightly the hand that has been placed in pocket 28 of device 50 will place rear portion 20 of the device, and thus image 22, in the general field of view of those seated above and behind the wearer 60. In the illustrated example, where the image 22 is a "#1", those in whose general field of view device 50 is positioned by wearer 60 will at one level of awareness or another observe and receive the message carried by image 22, for example that "the home team is the best" or a similar sentiment. Image 22, of course, could be any graphical, symbolic or alphanumeric symbol, including commercial logos and trademarks, in which event the raising of the wearer 60's hand would display the logo or mark to those above and behind wearer 60.

Figure 4:
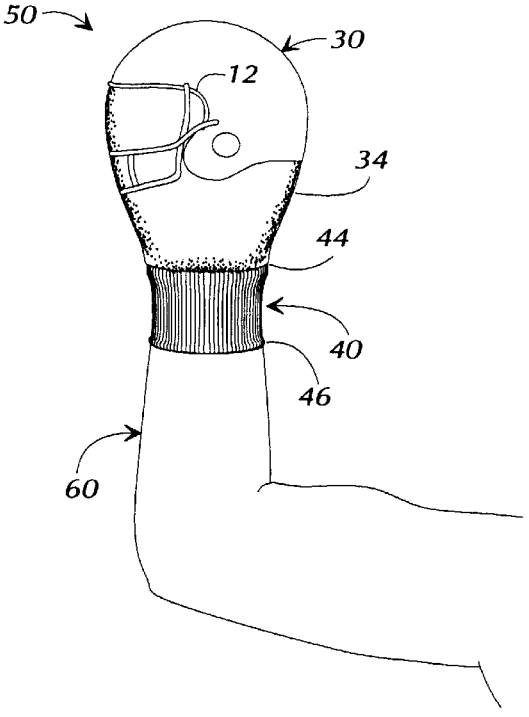
FIG. 4 shows a device according to the present invention in use, the frontal portion and corresponding display surface of the device being visible in this view.

FIG. 4 shows device 50 and the arm of wearer 60 from a vantage point opposite to that shown in FIG. 3. In this view, frontal portion 10, and therefore image 12, are visible. As can be appreciated from FIG. 3 and especially FIG. 4, images 12 and 22 can be as large or nearly as large as the display surfaces provided by front and rear portions 10 and 20, since the convex geometry of the surfaces includes no appreciable indentations or interruptions to accommodate the thumb or fingers. A wearer 60 who is a fan of a given team or athlete, such as a professional or college football team, could display image 12 toward the field as a gesture of spirit and support for the team. Image 12 in the embodiment shown in the figures is a football helmet, but could be any desired image. For instance, image 12 could be a graphic illustration, an alphanumeric symbol, or a logo or trademark. The football helmet of image 12 could bear the coloring and logo of the team supported by wearer 60, so that team members and others, including other fans and even media video cameras, would be potential recipients of wearer 60's communication of spirit, enthusiasm and support for that team.

In the presently described embodiment, the image is collocated with the device to achieve a visual effect in which the hand of the wearer becomes a two-dimensional surrogate for the object of interest. The precise peripheral contour 14 of frontal portion 10 and the matching peripheral contour 24 of rear portion 20 can be preselected to correspond to the geometry of a desired image to be communicated. As in the embodiment of the present invention shown in FIGS. 1, 2, and 4, image 12 is in the form of a football helmet, and the periphery of the football helmet of image 12 is seen to coincide with the peripheral contour 14 of frontal portion 10 and peripheral contour 24 of rear potion 20. The precise peripheral contour 14 of frontal portion 10 and the matching peripheral contour 24 of rear portion 20 could also be preselected to correspond to the geometry of a desired image to be communicated.

When wearer 60 raises his or her hand to display image 12 on the front portion 10 of device 50, he or she simultaneously communicates using image 22 on the rear portion 20 of the device 50. The ability to communicate, using a hand-wearable device, a first message in a first direction and a second message in a second direction, and in particular, one which can be visibly but unobtrusively raised above a crowd, presents a unique opportunity for promoters. A device 50 could be provided with a first image 12 on its frontal portion 10 corresponding to the team, athlete or other attraction of interest to the wearer 60, so that he or she can direct the message embodied by image 12 using his or her hand. Image 12 is shown as a football helmet, but could be any image that expresses the sentiment desired by wearer 60. The same device 50 could also be provided with a second image 22, which, rather than a simple "#1", as shown, could be a logo or trademark of a supplier of goods and services, a corporate sponsor, or other entity interested in maximizing its public visibility and, particularly, doing so in a setting where the viewer demographics are reasonably well understood.

The device 50 of the present invention is an effective but comparatively unobtrusive means for visual communication particularly at public events, and its effectiveness is enhanced by the ease with which it can be transported and used. Device 50 can be easily stored in the pocket or other convenient storage space of wearer 60. Wearer 60 could bring two devices 50 to a sporting or other public event and wear one on each hand simultaneously. Wearers 60 that are true devotees might even bring a larger number of versions of device 50 having differing images or colors that can be changed throughout the course of an athletic contest or event, the compactness of the device 50 enabling them to be easily stored and transported.

The simplicity and inexpensiveness of the devices 50 permit them to be produced and distributed on a large scale in many different versions. Thus, a team, athlete, corporate sponsor or other entity having images they and/or the wearers of the device are interested in displaying would easily be able to accommodate diverse wearer interests either by manufacturing and making available devices at a cost enabling the consumers to buy several of the devices, or even to collect them. Similarly, and particularly when manufactured on a large scale, the devices could be sufficiently inexpensive that they could be handed out on a complimentary basis by a corporate sponsor, similar to computer mousepads, cup coolers, key chains, calendars and other inexpensive and corporate message-bearing promotional gifts.

While the present invention has been described with reference to certain embodiments depicted in the accompanying drawings, one of ordinary skill in the art will recognize that other structures may embody the spirit of the invention as described herein and as set forth in the claims.

What is claimed is:

1. A hand-wearable device for permitting a wearer to communicate visually to one or more viewers, comprising:

a body portion having a first side consisting of a first continuous sheet of a thin, permeable lightweight material and a second side made of a second continuous sheet of a thin, permeable lightweight material surrounding an interior pocket for receiving a wearer's band, and having an aperture through one end and through which the hand passes when being received in the interior pocket, the body portion interior pocket adapted to receive the hand without presenting obstructions between the fingers, including the thumb, of the wearer's hand;

a neck portion affixed to the body portion and communicating with the aperture; and in which both the first side and the second side of the body portion have an image coupled thereto;

whereby the wearer can communicate with the one or more viewers by directing the hand that has been received in the device, and thereby the device itself, in the field of view of the one or more viewers such that the at least one image is visible in that field of view and the device can be folded so that it may be stored easily and unobtrusively in a clothing pocket or other personal storage space.

2. The device of claim 1, in which the image coupled to the first side is different from the image coupled to the second side.

3. A band-wearable device for permitting a wearer to communicate visually to a first set of one or more viewers, comprising:

a means for covering a frontal side of a wearer's hand comprising of a first continuous sheet of a thin, permeable, lightweight flexible material and a means for covering a rear side of the wearer's hand consisting a second continuous sheet of a thin, permeable, lightweight flexible material which frontal and rear hand covering means are attached to each other along their respective peripheries to define an interior pocket for receiving the hand and an aperture through which the hand passes when being received in the interior pocket with the interior pocket being adapted to receive the hand without presenting obstructions between the fingers, including the thumb, of the wearer's hand;

a neck portion affixed to the frontal and rear hand covering means and communicating with the aperture; and an image coupled to the frontal hand covering means;

a second image coupled to the rear hand covering means;

whereby the wearer can communicate with the set of viewers by directing the hand that has been received in the device, and thereby the device itself, in the field of view of the first set of viewers such that the image is visible in that field of view, the wearer can simultaneously communicate with a second set of viewers that is different from the first set of viewers, and the device can be folded and stored easily and unobtrusively in a clothing pocket or other personal storage space.

4. A hand-wearable device for permitting a wearer to communicate visually to a first set of one or more viewers, comprising:

a. a body portion consisting of;

1) a first continuous sheet of a thin, permeable, lightweight flexible material, 2) a second continuous single sheet of a thin, permeable, lightweight flexible material, 3) an interior pocket surrounded by the first sheet and the second sheet, which interior pocket has an aperture through an end and through which the wearer's hand may pass when being received in the interior pocket with the interior pocket being adapted to receive the hand without presenting obstructions between the fingers, including the thumb, of the wearer's hand and b. a neck portion affixed to the body portion and communicating with the aperture;

c. a first logo coupled to the first sheet; and d. a second logo coupled to the second sheet whereby (i) the wearer can display the first logo to the first set of viewers by directing the hand that has been received in the interior pocket, and thereby the device itself, in the field of view of the first set of viewers such that the first logo is visible in that field of view, (ii) the wearer can simultaneously display the second logo to a second set of viewers that is different from the first set of viewers, and (iii) the device can be folded so that it may be stored easily and unobtrusively in a clothing pocket or other personal storage space.

5. The device of claim 4 in which the first logo is a trademark.

6. A hand-wearable device for permitting a wearer to communicate visually to a first set of viewers, comprising:

a. a body portion comprising;

1) means consisting of a continuous sheet of a thin, permeable, lightweight flexible material for covering a frontal side of the wearer's hand, 2) means consisting of a continuous sheet of a thin, permeable, lightweight flexible material for covering a rear side of the wearer's hand, and 3) an interior pocket that:

A. is surrounded by the frontal hand covering means and the rear hand covering means, B. is substantially continuous without obstructions between the fingers, including the thumb, of the wearer's hand, and C. includes an aperture for receiving the wearer's hand;

b. a neck portion affixed to the body portion and in communication with the aperture c. a first logo coupled to the frontal hand covering means; and d. a second logo coupled to the rear hand covering means whereby (i) the wearer can display the first logo to the first set of viewers by placing the hand in the field of view of the first set of viewers and (ii) the device can be folded so that it may be stored easily and unobtrusively in a clothing pocket.

7. The device of claim 6, whereby the wearer can simultaneously display the second logo to a second set of viewers that is different from the first set of viewers.

8. The device of claim 7 in which the first logo is different from the second logo.

* * * * *